US011850857B2

(12) United States Patent
Yamamoto et al.

(10) Patent No.: US 11,850,857 B2
(45) Date of Patent: Dec. 26, 2023

(54) LIQUID DISCHARGING HEAD

(71) Applicant: Brother Kogyo Kabushiki Kaisha, Nagoya (JP)

(72) Inventors: Jiro Yamamoto, Nagoya (JP); Yoshitsugu Morita, Nagoya (JP); Yasuhiro Sekiguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 29 days.

(21) Appl. No.: 17/559,029

(22) Filed: Dec. 22, 2021

(65) Prior Publication Data

US 2022/0250383 A1 Aug. 11, 2022

(30) Foreign Application Priority Data

Feb. 9, 2021 (JP) ..... 2021-019166

(51) Int. Cl.
*B41J 2/14* (2006.01)

(52) U.S. Cl.
CPC .. *B41J 2/14233* (2013.01); *B41J 2002/14419* (2013.01)

(58) Field of Classification Search
None
See application file for complete search history.

(56) References Cited

U.S. PATENT DOCUMENTS 9,233,535 B2 1/2016 Ito
2011/0069118 A1* 3/2011 Ohzeki ..... B41J 2/14233 347/44
2013/0082117 A1 4/2013 Ito
2019/0084305 A1* 3/2019 Sugiura ..... B41J 2/14233

FOREIGN PATENT DOCUMENTS

JP 2013-075404 A 4/2013

* cited by examiner

*Primary Examiner* — Erica S Lin
(74) *Attorney, Agent, or Firm* — Banner & Witcoff, Ltd.

(57) ABSTRACT

A liquid discharging head includes: manifolds to which liquid is supplied; at least one nozzle row associated with each of the manifolds; and a communicating channel directly connecting two manifolds which are included in the manifolds and which are adjacent to each other. The at least one nozzle row includes nozzles configured to discharge the liquid, the nozzles communicating with one manifold with which the at least one nozzle row is associated. A first number is a number of the nozzle row associated with one of the two manifolds and a second number is a number of the nozzle row associated with the other of the two manifolds, and a cross-sectional area of the communicating channel is different between a case that a first number and a second number are same, and another case that the first number and the second number are different.

10 Claims, 10 Drawing Sheets

LIQUID DISCHARGING HEAD

CROSS REFERENCE TO RELATED APPLICATIONS

The present application claims priority from Japanese Patent Application No. 2021-019166, filed on Feb. 9, 2021, the disclosure of which is incorporated herein by reference in its entirety.

BACKGROUND

Field of the Invention

The present disclosure relates to a liquid discharging head discharging liquid such as ink, etc.

BACKGROUND

Description of the Related Art

There is a conventionally known liquid discharging head having first to third supply manifolds which are arranged side by side in a main scanning direction. In this liquid discharging head, a plurality of nozzles are communicated with each of the first to third manifolds, and the plurality of nozzles form two nozzle rows. Each of the two nozzle rows extends along a longitudinal direction of one of the first to third supply manifolds. One ends in the longitudinal direction of the first to third supply manifolds are connected to a supply hole, and the other ends in the longitudinal direction of the first to third supply manifolds are communicated with one another by a communicating channel, By providing such a communicating channel, an effect of mitigating of any concentration in pressure occurring in the vicinity of the other end of each of the supply manifolds and of suppressing any variation between discharge from a certain nozzle communicated with a location in the vicinity of the other end and discharge from another nozzle different from the certain nozzle.

SUMMARY

However, a flow of liquid in the communicating channel is generated only by a difference in a flow amount of the liquid between the supply manifolds connected to the communicating channel. Accordingly, in the above-described configuration, in a case that the channel cross-sectional area of the communicating channel is too great, there is such a fear that only a weak flow might be generated and any air might remain in the communicating channel. On the other hand, in a case that the channel cross-sectional area of the communicating channel is too small, there is such a fear that there might be no escape for the pressure inside of the communicating channel and that the concentration in pressure in the vicinity of the other end of each of the supply manifolds might not be improved.

An object of the present disclosure is to provide a liquid discharging head configured to suppress any remaining of the air in the communicating channel connecting adjacent manifolds, and to suppress any concentration in the pressure.

According to an aspect of the present disclosure, there is provided a liquid discharging head including:

a plurality of manifolds to which liquid is supplied;

at least one nozzle row associated with each of the manifolds; and a communicating channel directly connecting two manifolds which are included in the manifolds and which are adjacent to each other, wherein the at least one nozzle row includes a plurality of nozzles configured to discharge the liquid, the nozzles communicating with one manifold with which the at least one nozzle row is associated, a first number is a number of the nozzle row associated with one of the two manifolds and a second number is a number of the nozzle row associated with the other of the two manifolds, and a cross-sectional area of the communicating channel is different between a case that a first number and a second number are same, and another case that the first number and the second number are different.

According to the present disclosure, as compared with a conventional aspect wherein the cross-sectional area of the communicating channel is constant regardless of the first number (number of the nozzle row in the one manifold) and the second number (number of the nozzle row in the other manifold), it is possible to cause an appropriate amount of the liquid to flow in the communicating channel. Specifically, in a case that the cross-sectional area of the communicating channel is too great, there is such a fear that only a weak flow might be generated and any air might remain in the communicating channel. On the other hand, in a case that the channel cross-sectional area of the communicating channel is too small, there is such a fear that there might be no escape for the pressure inside of the communicating channel and that the concentration in the pressure might not be improved. In the present disclosure, since the cross-sectional area of the communicating channel is made different depending on whether the first number and the second number are same or different, it is possible to cause an appropriate amount of the liquid to flow in the communicating channel and to suppress any remaining of the air, and to suppress the concentration in the pressure as well. Specifically, in the case that the first number and the second number are different, any difference in the flow amount is likely to occur between the one manifold and the other manifold, there is a little fear that the remaining of the air might occur in the communicating channel. However, since the concentration in the pressure occurs in a case that the cross-sectional area of the communicating channel is small, a communicating channel having a relatively large cross-sectional area is provided so as to suppress the concentration in the pressure. In contrast, in the case that the first number and the second number are same, although the concentration in the pressure is relatively less likely to occur, the fear of the remaining of air is great since the difference in the flow amount is less likely to occur. Accordingly, a communicating channel having a relatively small cross-sectional area is provided in view of forming a flow which is sufficient to exhaust or discharge the air in the communicating channel. Owing to the above-described configuration, it is possible to suppress any remaining of the air, and to suppress the concentration in the pressure as well.

According to the present disclosure, it is possible to provide a liquid discharging head capable of suppressing any remaining of the air in the communicating channel connecting adjacent manifolds, and suppressing any concentration in the pressure.

DETAILED DESCRIPTION

In the following, a liquid discharging head according to an embodiment of the present disclosure will be explained, with reference to the drawings. The liquid discharging head explained in the following is merely an embodiment of the present disclosure. Accordingly, the present disclosure is not limited to or restricted by the following embodiment; any addition, deletion and/or change are/is possible within the range not departing from the gist and spirit of the present disclosure.

Figure 1:
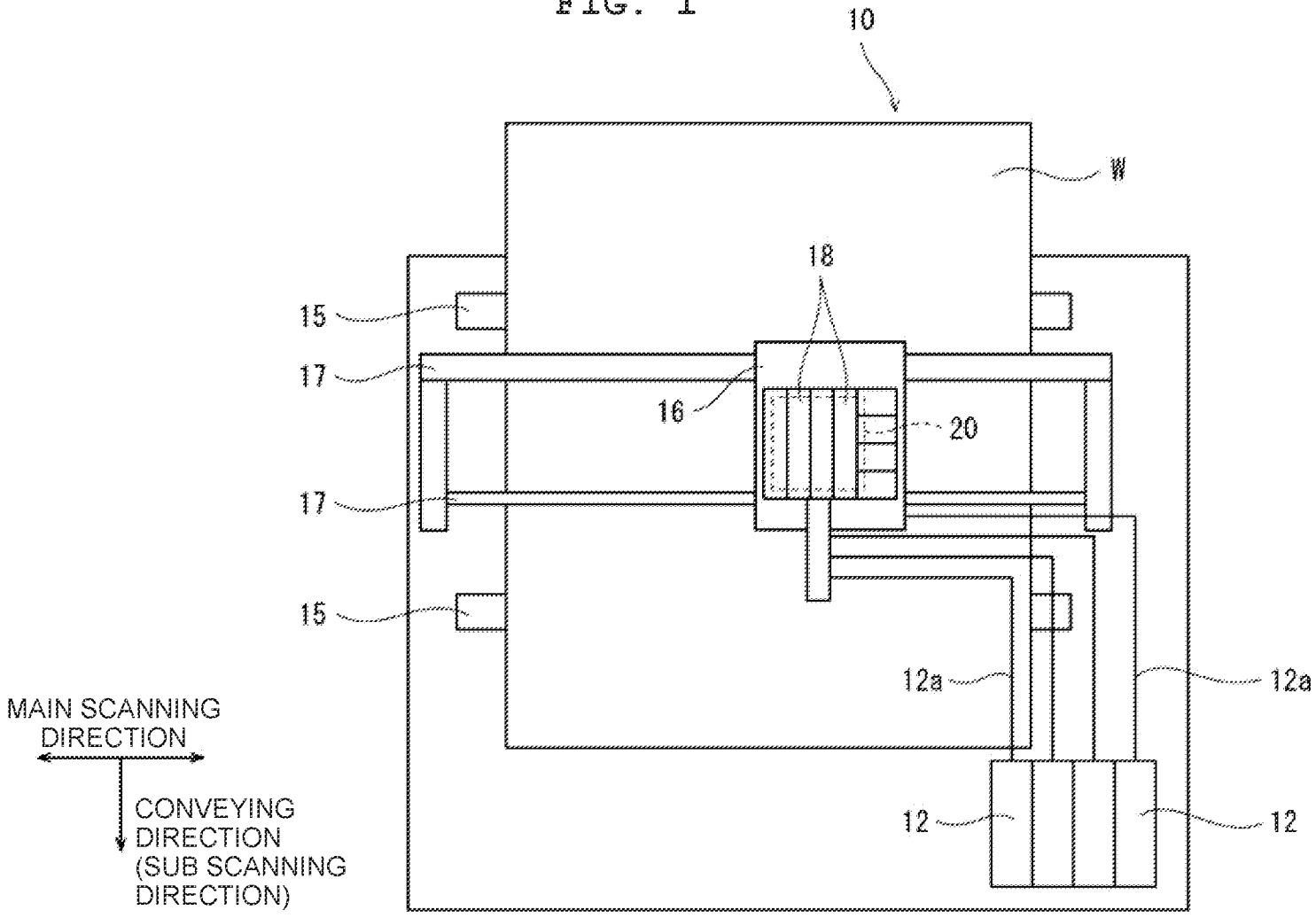
FIG. 1 is a plane view schematically depicting the configuration of a liquid discharging apparatus according to an embodiment of the present disclosure.

As depicted in FIG. 1, a liquid discharging head 20 of the present embodiment is provided on a liquid discharging apparatus 10. The liquid discharging apparatus 10 includes a storing tank 12, a carriage 16, a pair of conveying rollers 15, a pair of guide rails 17 and a sub tank 18, in addition to the liquid discharging head 20 configured to discharge liquid. Note that in the liquid discharging apparatus 10, a discharge medium W which is, for example, print paper (print paper sheet) is arranged on a platen (not depicted in the drawings).

The liquid discharging head 20 and the sub tank 18 are mounted on the carriage 16. The pair of guide rails 17 extend in a main scanning direction orthogonal to a conveying direction of the discharge medium W (sub scanning direction). The carriage 16 is supported by the pair of guide rails 17, and moves reciprocally in the main scanning direction along the pair of guide rails 17, With this, the liquid discharging head 20 moves reciprocally in the main scanning direction. The liquid discharging head 20 is connected to the storing tank 12 via a tube 12*a*.

The pair of conveying rollers 15 are arranged to be parallel to each other along the main scanning direction. In a case that a conveying motor (not depicted in the drawings) is driven, the pair of conveying rollers 15 rotates. With this, the discharge medium W on the platen is conveyed in the conveying direction.

An ink, as an example of the liquid, is stored in the storing tank 12. The storing tank 12 is connected to the liquid discharging head 20 via the tube 12*a* so as to supply the liquid to the liquid discharging head 20. Further, in a case that the liquid is the ink, the storing tank 12 is provided per a kind of the ink. The storing tank 12 is provided, for example, as four storing tanks 12, and black, yellow, cyan and magenta inks each as the liquid are stored in the four storing tanks 12, respectively. Note that the following explanation will be made regarding a case wherein the ink(s) is (are) used as the liquid.

Figure 2:
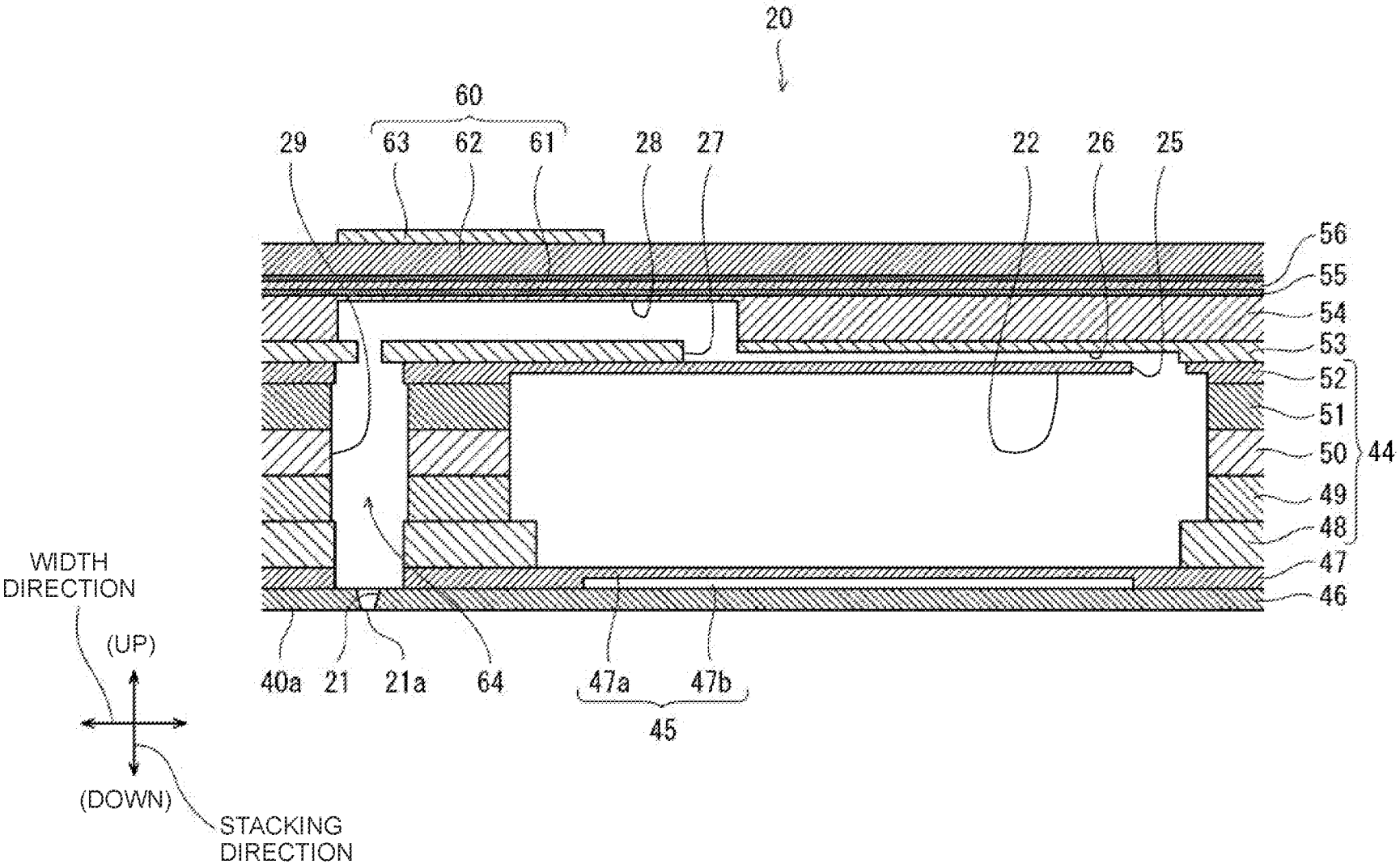
FIG. 2 is a cross-sectional view of the configuration of a liquid discharging head of FIG. 1.

Next, the cross-sectional configuration of the liquid discharging head 20 will be explained, with reference to FIG. 2. As depicted in FIG. 2, the liquid discharging head 20 has a plurality of nozzles 21 configured to discharge droplets of the liquid (liquid droplets) by using the ink(s) from the storing tank(s) 12. The liquid discharging head 20 is a stacked body of a channel forming body and a volume changing part. In the stacked body, an ink channel is formed inside of the channel forming body, and a plurality of nozzle holes 21*a* are opened in a discharge surface 40*a* which is a lower surface of the channel forming body. Further, in a case that the above-described volume changing part is driven, the volume of the ink channel is thereby changed, in this situation, meniscus is vibrated in the nozzle holes 21*a*, thereby discharging the ink.

The channel forming body of the liquid discharging head 20 is a stacked body of a plurality of plates, and the volume changing part includes a vibration plate 55 and an actuator (piezoelectric element) 60.

The plurality of plates includes a nozzle plate 46, a spacer plate 47, a first channel plate 48, a second channel plate 49, a third channel plate 50, a fourth channel plate 51, a fifth channel plate 52, a sixth channel plate 53 and a seventh channel plate 54 which are stacked, in this order, from a lower side.

Each of the plurality of plates is formed with holes and grooves of various sizes. The holes and the grooves are combined within the channel forming body in which the respective plates are stacked, and the plurality of nozzles 21, a plurality of individual channels 64, and a supply manifold 22 are formed as the ink channel. Note that the supply manifold 22 and a supply manifold 122 which is to be described later on each correspond to a "manifold".

The plurality of nozzles 21 are formed to penetrate through the nozzle plate 46 in a stacking direction. In the discharge surface 40*a* of the nozzle plate 46, the plurality of nozzles holes 21*a* which are forward ends, respectively, of the plurality of nozzles 21 are aligned in an aligning direction to form a nozzle row. Note that the aligning direction is a direction orthogonal to the stacking direction.

The supply manifold 22 supplies the ink to a pressure chamber 28 (to be described later on) to which a discharge pressure of the ink is applied. The supply manifold 22 extends in the aligning direction and is connected to an end of each of the plurality of individual channels 64. Namely, the supply manifold 22 functions as a common channel of the ink. The supply manifold 22 is formed by stacking, in the stacking direction, through holes each of which penetrates through one of the first to fourth channel plates 48 to 51 in the stacking direction and a recess which is recessed from a lower surface of the fifth channel plate 52.

The nozzle plate 46 is arranged at a location below the spacer plate 47. The spacer plate 47 is formed, for example, of stainless steel. The space plate 47 is recessed, for example, by half etching from a surface, of the spacer plate 47, on the side of the nozzle plate 46 in a thickness direction of the spacer plate 47 so that the spacer plate 47 has a recessed part 45 in which a thinned part forming a damper part 47*a* and a damper space 47*b* are formed. By such a configuration, the damper space 47*b* as a buffer space is formed between the supply manifold 22 and the nozzle plate 46.

Each of the plurality of individual channels 64 is connected to the supply manifold 22. Each of the plurality of individual channels 64 has an upstream end connected to the supply manifold 22 and a downstream end connected to a base end of one of the plurality of nozzles 21. Each of the plurality of individual channels 64 has a first communicating hole 25, a supply throttle channel 26 which is an individual throttle channel, a second communicating hole 27, a pressure chamber 28 and a descender 29; and these constituent elements are arranged in this order.

The first communicating hole 25 has a lower end connected to an upper end of the supply manifold 25, the first communicating hole 25 extends from the supply manifold 22 upward in the stacking direction, and penetrates through an upper part in the fifth channel plate 52.

An upstream end of the supply throttle channel 26 is connected to an upper end of the first communicating hole 25. The supply throttle channel 26 is formed, for example, by the half etching, and is constructed of a recess which is recessed from the lower surface of the sixth channel plate 53. Further, the second communicating hole 27 has an upstream end connected to a downstream end of the supply throttle channel 26, the second communicating hole 27 extends from the supply throttle channel 26 upward in the stacking direction, and is formed to penetrate through the sixth channel plate 53 in the stacking direction.

The pressure chamber 28 has an upstream end connected to a downstream end of the second communicating hole 27. The pressure chamber 28 is formed to penetrate through the seventh channel plate 54 in the stacking direction.

The descender 29 is formed to penetrate through the space plate 47, the first channel plate 48, the second channel plate 49, the third channel plate 50, the fourth channel plate 51, the fifth channel plate 52 and the sixth channel plate 53 in the stacking direction. The descender 29 has an upstream end connected to a downstream end of the pressure chamber 28 and a downstream end connected to the base end of each of the plurality of nozzles 21. Each of the plurality of nozzles 21 overlaps, for example, in the stacking direction with the descender 29, and is arranged at the center in the width direction of the descender 29.

The vibration plate 55 is stacked on the seventh channel plate 54, and covers an opening of an upper end of the pressure chamber 28. An insulating film 56 is formed on the vibration plate 55, and the actuator 60 is formed on the insulating film 56.

The actuator 60 includes a common electrode 61, a piezoelectric layer 62 and an individual electrode 63 which are stacked in this order. The common electrode 61 is formed on the insulating film 56 so as to cover an entire surface of the vibration plate 55. The piezoelectric layer 62 is formed on the common electrode 61 so as to cover the entire surface of the vibration plate 55. The individual electrode 63 is provided on the piezoelectric layer 62 with respect to each piece of the pressure chamber 28. One piece of the actuator 60 is constructed of one piece of the individual electrode 63, the common electrode 61 and a part (active part), of the piezoelectric layer 62, which is sandwiched 1*w* one piece of the individual electrode 63 and the common electrode 61.

The individual electrode 63 is electrically connected to the driver IC. The driver IC receives a control signal from a controller (not depicted in the drawings), generates a driving signal (voltage signal) and applies the generated driving signal to the individual electrode 63. With respect to this, the common electrode 61 is always maintained at the ground potential. In such a configuration, the active part of the piezoelectric layer 62 expands and contracts in a plane direction together with two electrodes 61 and 63, depending on the driving signal. Accompanying with this, the vibration plate 55 deforms in a direction increasing or decreasing the volume of the pressure chamber 28. With this, a discharge pressure for causing the ink to be discharged from the nozzle 21 is applied to the pressure chamber 28.

Figure 3:
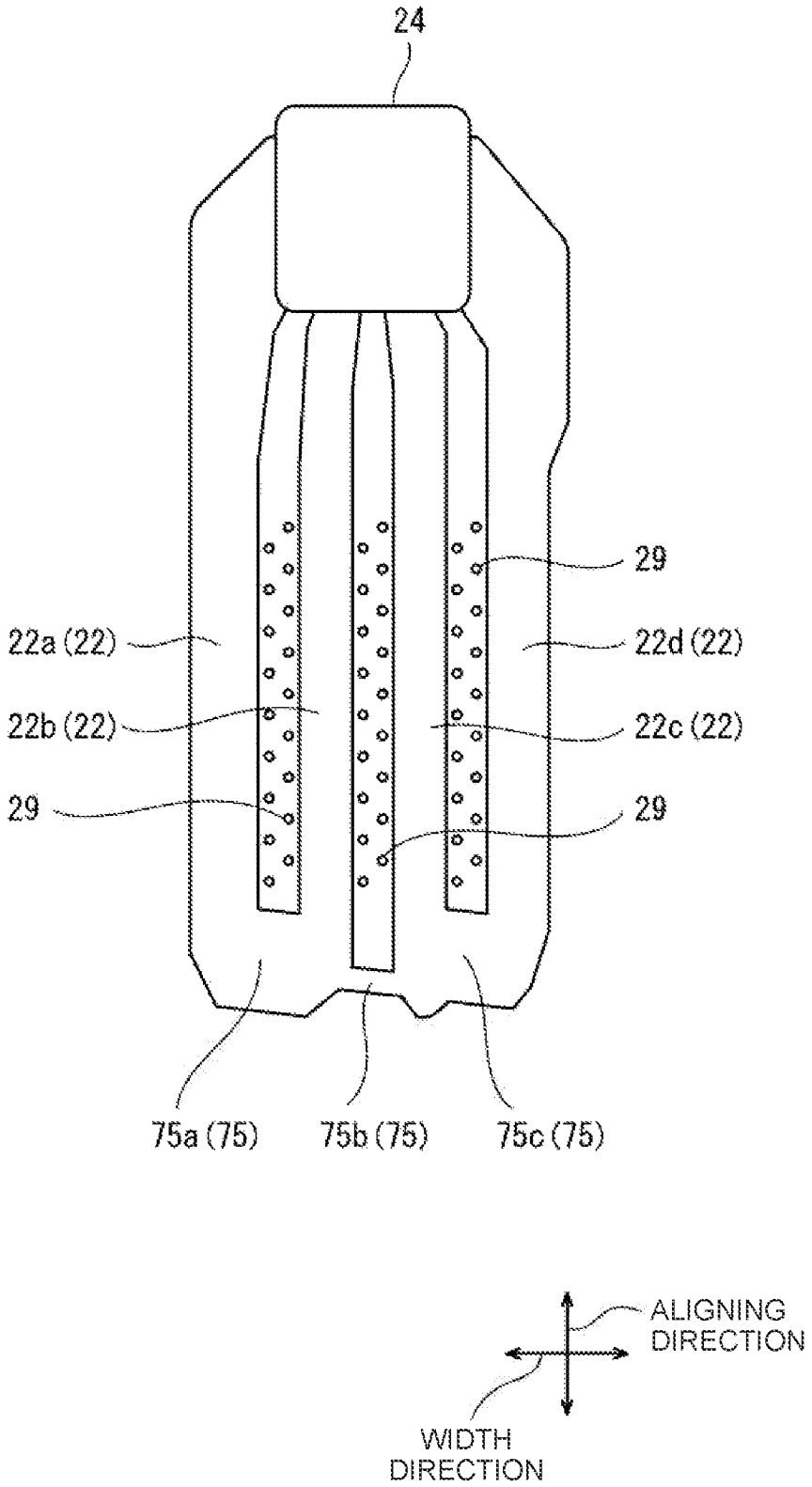
FIG. 3 is a plane view of a liquid channel in the liquid discharging head of FIG. 1.

In a case that a pump (not depicted in the drawings) is driven in the liquid discharging head 20 as described above, the ink flows from the sub tank 18 into the supply manifold 22 via the supply hole 24 (FIG. 3). Then, the ink flows from the supply manifold 22 into the supply throttle channel 26 via the first communicating hole 25, and flows from the supply throttle channel 26 into the pressure chamber 28 via the second communicating hole 27. Then, the ink flows in the descender 29 and flows into the nozzle 21. Here, in a case that the discharge pressure is applied by the actuator 60 to the pressure chamber 28, the ink is discharged from the nozzle hole 21*a*.

Next, an explanation will be given about the overall configuration of a liquid channel in the liquid discharging head 20, with reference to FIG. 3, As depicted in FIG. 3, the liquid discharging head 20 has the supply hole 24 to which the liquid is supplied and which has, for example, a substantially square shape in a plane view. The supply hole 24 is connected to the sub tank 18 via a piping. The supply hole 24 is formed, for example, to have a tubular shape, and is arranged at one end in the aligning direction (the extending direction of the supply manifold 22) which crosses the width direction.

A plurality of pieces of the supply manifold 22 are arranged at a location below the supply hole 24. In the present embodiment, for example, four supply manifolds 22*a*, 22*b*, 22*c* and 22*d* are arranged in this order in the width direction, as the plurality of manifolds 22. Each of the four supply manifolds 22*a*, 22*b*, 22*c* and 22*d* extends in the aligning direction. Adjacent supply manifolds 22, which are adjacent to each other, among the plurality of manifolds 22 are directly connected by a communicating channel 75. Specifically, the supply manifold 22*a* and the supply manifold 22*b* are directly connected by a communicating channel 75*a*. The supply manifold 22*b* and the supply manifold 22*c* are directly connected by a communicating channel 75*b*. the supply manifold 22*c* and the supply manifold 22*d* are directly connected by a communicating channel 75*c*. The details of the communicating channels 75*a*, 75*b* and 75*c* will be described later on. Note that the number of the supply manifold 22 is not limited to or restricted by 4 (four). The supply manifold 22*a* corresponds to a "first manifold", the supply manifold 22*b* corresponds to a "second manifold", the supply manifold 22*c* corresponds to a "third manifold", and the supply manifold 22*d* corresponds to a "fourth manifold".

Next, an explanation will be given about a plurality of manifold holes 70 communicating with the supply hole 24, and a partition wall 72 partitioning adjacent manifold holes 70 which are included in the plurality of manifold holes 70 and which are adjacent to each other, with reference to FIGS. 4 and 5.

Figure 4:
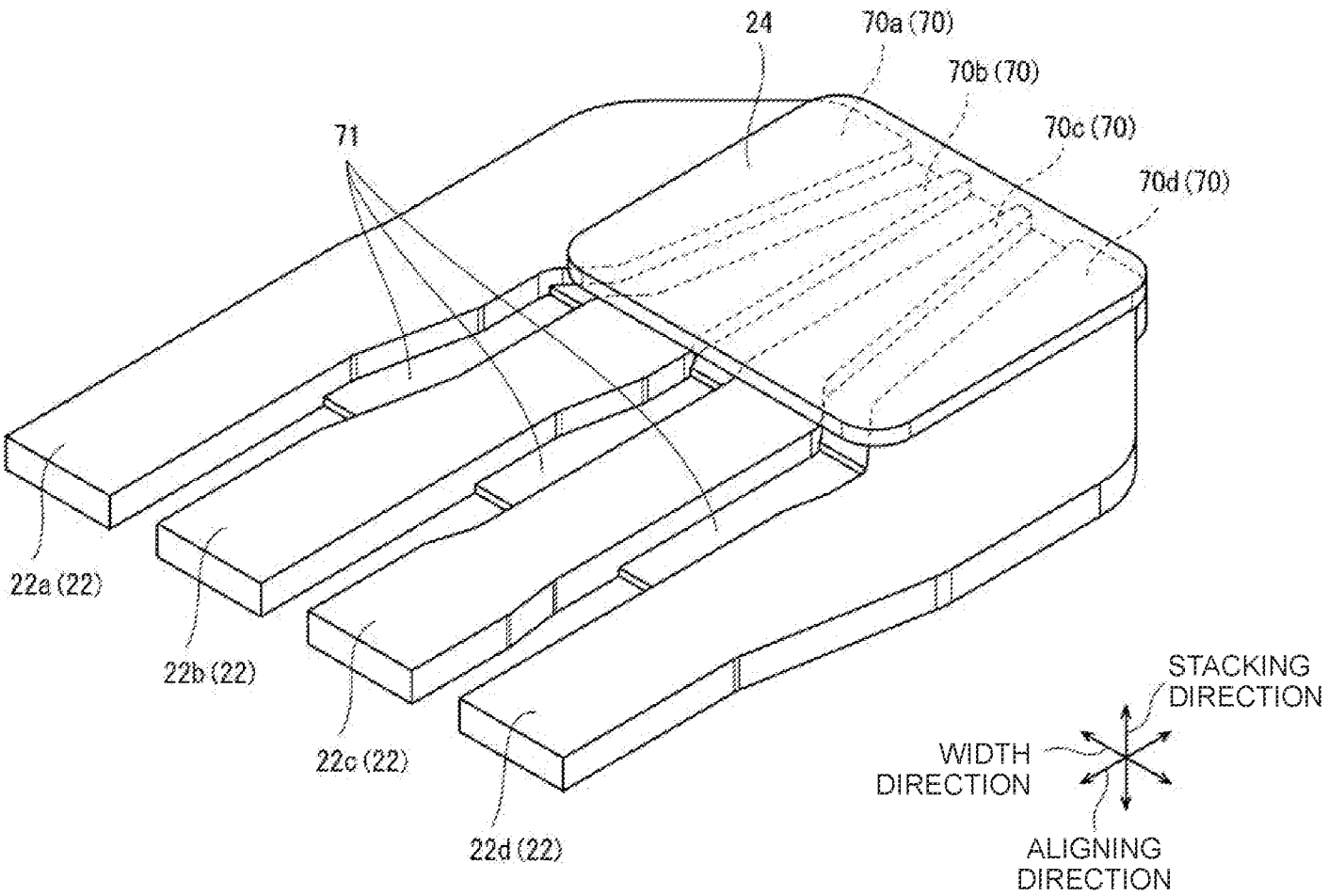
FIG. 4 is a perspective view of a manifold hole and a supply hole.
Figure 5:
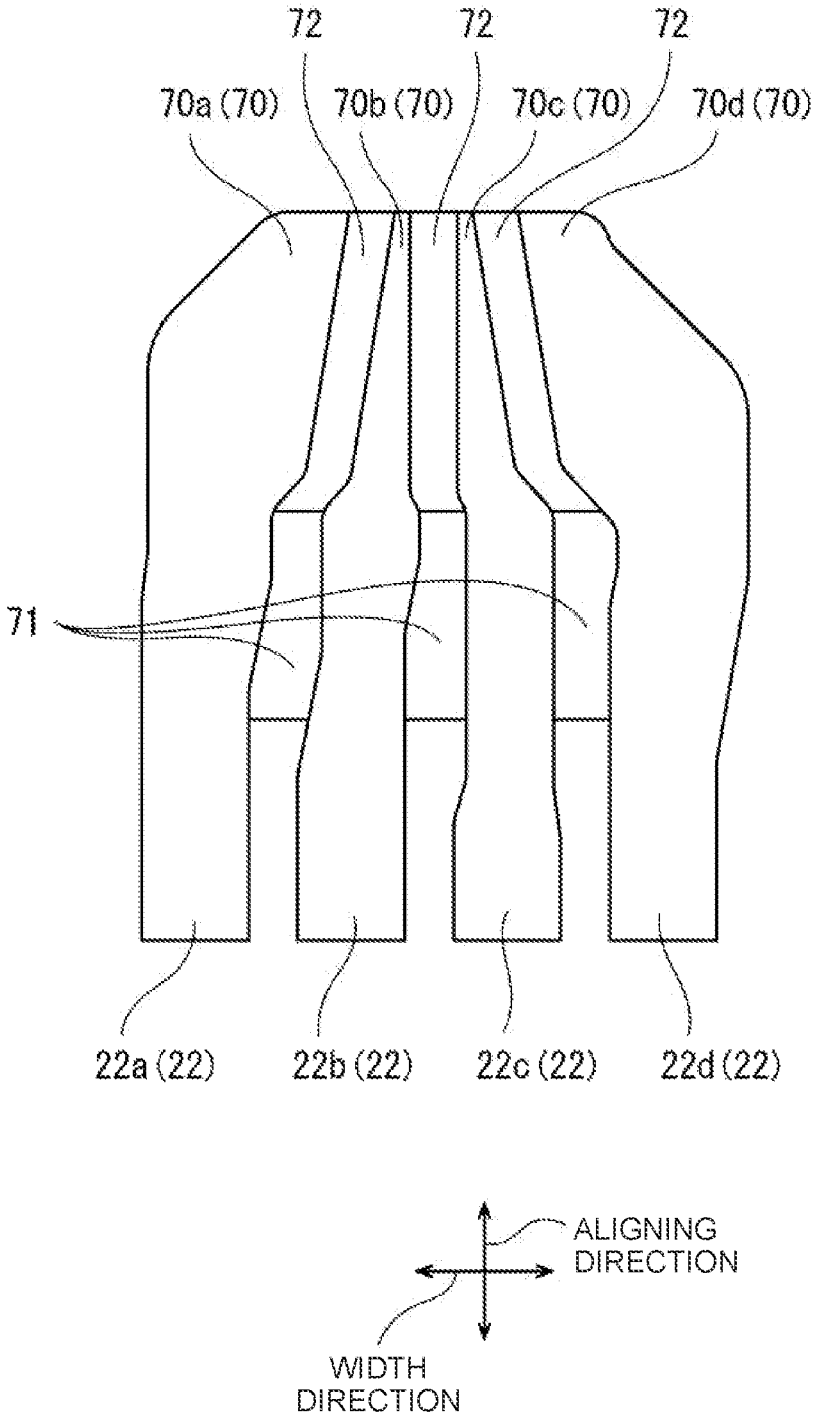
FIG. 5 is a plane view of the manifold hole, the supply hole and a partition wall.

FIG. 4 and FIG. 5 each depict a configuration of a case of using a black ink as the liquid, or a configuration of another case of using four color inks (black, magenta, cyan and yellow) as the liquid. Further note that although each of the supply hole 24, the plurality of supply manifolds 22 and the plurality of manifold holes 70 (which will be described later on) is a liquid channel and a hollow, FIG. 4 and FIG. 5 each depict the hollow with an outer line, so that the configuration will be easily understood. This is similarly applicable to FIG. 6 and FIGS. 8 to 10 which will be described later on.

As depicted in FIG. 4, the supply manifolds 22*a*, 22*b*, 22*c* and 22*d* have manifold holes 70*a*, 70*b*, 70*c* and 70*d*, respectively. The manifold holes 70*a*, 70*b* 70*c* and 70*d* are each long in the aligning direction, and each extends obliquely with respect to the aligning direction. Specifically, in FIG. 5, a part of an inner wall defining the manifold hole 70*a* extends obliquely with respect to the aligning direction. A part of an inner wall defining the manifold hole 70*b* extends parallel to the aligning direction, whereas another part of the inner wall defining the manifold hole 70*b* extends obliquely with respect to the arranging line. Further, a part of an inner wall defining the manifold hole 70*c* extends parallel to the aligning direction, whereas another part of the inner wall defining the manifold hole 70*c* extends obliquely with respect to the arranging line. Furthermore, a part of an inner wall defining the manifold hole 70*d* extends obliquely with respect to the aligning direction. In such a configuration, a partition wall 72 partitioning the manifold hole 70*a* and the manifold hole 72*b* extends obliquely with respect to the aligning direction; a partition wall 72 partitioning the manifold hole 70*b* and the manifold hole 72*c* extends parallel to the aligning direction; and a partition wall 72 partitioning the manifold hole 70*c* and the manifold hole 72*d* extend obliquely with respect to the aligning direction. Further, in the present embodiment, the manifold holes 70*a*, 70*b*, 70*c* and 70*d* each have a shape in which a width thereof is gradually widen (widen in a stepped manner) in the aligning direction.

The manifold holes 70*a*, 70*b*, 70*c* and 70*d* are arranged at a location below the supply hole 24. Each of the manifold holes 70*a*, 70*b*, 70*c* and 70*d* is communicated with the supply hole 24. With this, each of the supply manifolds 22*a*, 22*b*, 22*c* and 22*d* is communicated with the supply hole 24.

As depicted in FIG. 5, one and the other of adjacent supply manifolds which are adjacent to each other among the supply manifolds 22*a*, 22*b*, 22*c* and 22*d* are partitioned from each other by the partition wall 72. With this, also regarding the manifold holes 70*a*, 70*b*, 70*c* and 70*d*, one and the other of adjacent manifold holes which are adjacent to each other among the manifold holes 70*a*, 70*b*, 70*c* and 70*d* are also partitioned from each other by the partition wall 72.

The supply manifolds 22*a*, 22*b*, 22*c* and 22*d* are communicated with one another in a common space 71 defined at a location below the respective partition walls 72. A downstream end of the common space 71 is located at the downstream of one end and the other end of the respective partition walls 72.

Figure 6:
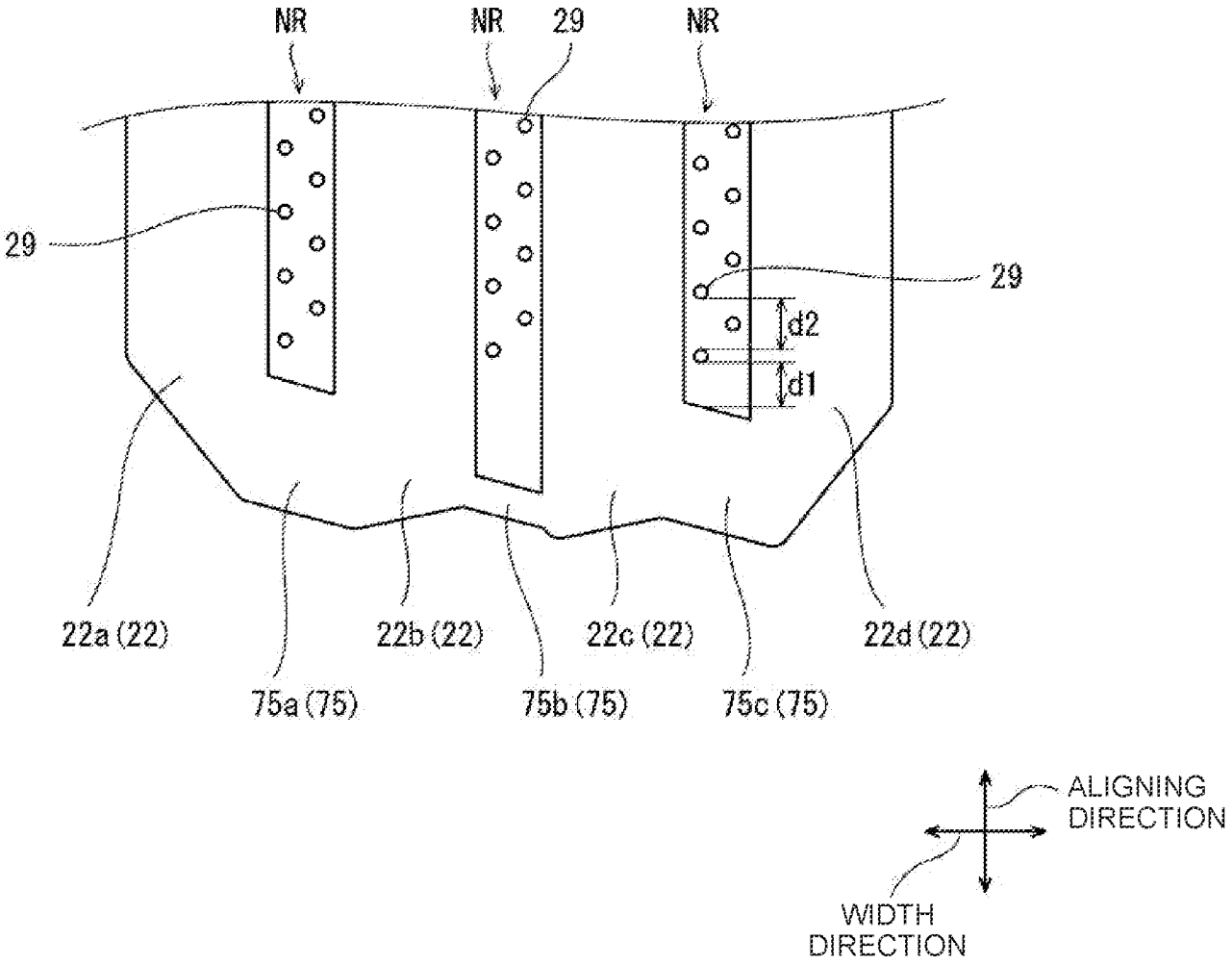
FIG. 6 is a plane view of a communicating channel communicating adjacent supply manifolds to each other.

Next, the communicating channel 75 communicating the adjacent supply manifolds 22 to each other will be explained, with reference to FIG. 6. As depicted in FIG. 6, one piece or a plurality of pieces of a nozzle row NR is/are, associated with each of the four supply manifolds 22. Each of the nozzle rows NR includes a plurality of nozzles 21, and extends in the aligning direction.

In FIG. 6, one nozzle row NR is associated with one side in the width direction of each of the manifold 22*a* and the manifold 22*d*. Specifically, the nozzle row NR of the supply manifold 22*a* is connected to an inner side in the width direction of the supply manifold 22*a*, and the nozzle row NR of the supply manifold 22*d* is connected to an inner side in the width direction of the supply manifold 22*d*, On the other hand, two nozzle rows NR are associated with the both sides, respectively, in the width direction of to each of the supply manifolds 22*b* and 22*c*.

Here, there is provided the communicating channel 75 directly connecting the manifolds 22, which are adjacent to each other in the width direction, to each other. With this, one and the other of the adjacent supply manifolds 22 are directly communicated with each other by the communicating channel 75.

Specifically, the supply manifold 22*a* and the supply manifold 22*b* are connected to each other by the communicating channel 75*a*. With this, the supply manifold 22*a* and the supply manifold 22*b* are communicated with each other by the communicating channel 75*a*. Further, the supply manifold 22*b* and the supply manifold 22*c* are connected to each other by the communicating channel 75*b*. With this, the supply manifold 22*b* and the supply manifold 22*c* are communicated with each other by the communicating channel 75*b*. Furthermore, the supply manifold 22*c* and the supply manifold 22*d* are connected to each other by the communicating channel 75*c*. With this, the supply manifold 22*c* and the supply manifold 22*d* are communicated with each other by the communicating channel 75*c*.

In the configuration as described above, a channel cross-sectional area of the communicating channel 75 is different between a case that a first number which is a number of the nozzle row NR associated with one supply manifold 22 of the adjacent supply manifolds 22 which are adjacent to each other in the width direction and a second number which is a number of the nozzle row NR associated with the other supply manifold 22 of the adjacent supply manifolds 22 are same, and another case that the first number and the second number are different. In the present embodiment, in the case that the first number and the second number are different, the channel cross-sectional area of the communicating channel 75 is great, as compared with another case that the first number and the second number are same.

Specifically, in FIG. 6, the two nozzle rows NR are connected to each of the supply manifold 22*b* and the supply manifold 22*c* which are adjacent to each other. Accordingly, the first number and the second number are same. In contrast, one nozzle row NR is connected to the supply manifold 22*a*, whereas two nozzle rows NR are connected to the supply manifold 22*b*. Accordingly, the first number and the second number are different. Further, although two nozzle rows NR are connected to the supply manifold 22*d*, one nozzle row NR is connected to the supply manifold 22*d*, Accordingly, the first number and the second number are different. Accordingly, the channel cross-sectional area of the communicating channel 75*b* connecting the supply manifold 22*b* and the supply manifold 22*c* is smaller than the channel cross-sectional area of the communicating channel 75*a* connecting the supply manifold 22*a* and the supply manifold 22*b*. In this case, the maximum value of the channel cross-sectional area of the communicating channel 75*b* is smaller than the minimum value of the channel cross-sectional area of the communicating channel 75*a*. Similarly, the channel cross-sectional area of the above-described communicating channel 75*b* is smaller than the channel cross-sectional area of the communicating channel 75*c* connecting the supply manifold 22*c* and the supply manifold 22*d*. In this case, the maximum value of the channel cross-sectional area of the communicating channel 75*b* is smaller than the minimum value of the channel cross-sectional area of the communicating channel 75*c*.

In the present embodiment, a channel resistance in the communicating channel 75 in the case that the first number and the second number are same, specifically, a channel resistance in the communicating channel 75*b* in FIG. 6 is, for example, in a range of 1000 kPa·s/ml to 2000 kPa·s/ml. On the other hand, a channel resistance in the communicating channel 75 in the case that the first number and the second number are different, specifically, a channel resistance in each of the communicating channels 75*a* and 75*c* in FIG. 6 is, for example, in a range of 100 kPa·s/ml to 300 kPa·s/ml.

Here, the present embodiment has the following configuration in order to make the width of the communicating channel 75 to great as much as possible under the premise that the communicating channel 75 and the descenders 29 do not overlap with each other in the up-down direction or vertically. Namely, in the case that the first number and the second number are different, a spacing distance between the communicating channel 75 and a descender 29 which is included in the plurality of descenders 29 and which is located closest to the communicating channel 75 is not more than a spacing distance between adjacent descenders 29 which are included in the plurality of descenders 29 and which are adjacent to each other. Specifically, for example in FIG. 6, a spacing distance d1 between the communicating channel 75 and the descender 29 which is located closest to the communicating channel 75 is not more than a spacing distance d2 between the adjacent descenders 29. With this, it is possible to make the width of the communicating channel 75 to be great. Note that the spacing distance d2 as described above is, for example, in a range of 400 μm to 500 μm, and the spacing distance d1 as described above is, for example, in a range of 100 μm to 400 μm.

Figure 7:
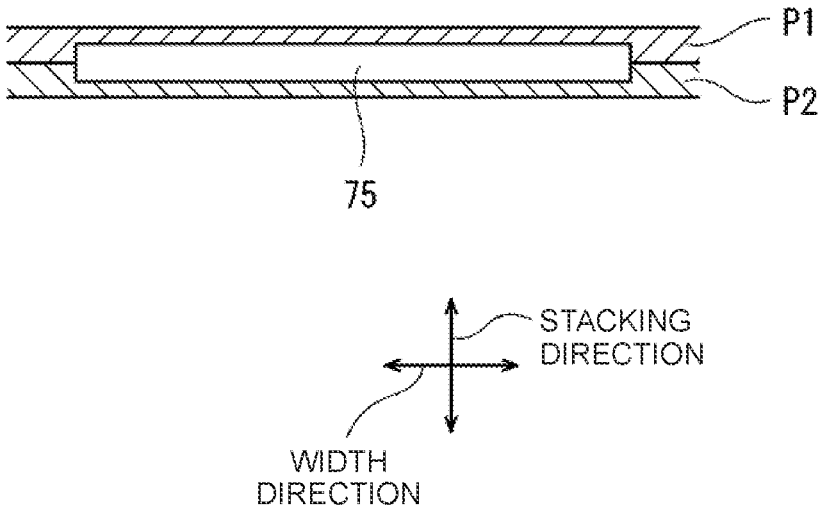
FIG. 7 is a cross-sectional view of plates forming the communicating channel.

The communicating channel 75 as explained above can be formed in the following manner. As depicted in FIG. 7, the communicating channel 75 is formed by performing half etching for each of two layer plates P1 and P2. Note that although the supply manifolds 22 corresponding to one end in the width direction and the other end in the width direction of the communicating channel 75, respectively, are connected thereto, the illustration of the supply manifolds 22 are omitted in FIG. 7 so that the cross-sectional structure of the plates P1 and P2 forming the communicating channel 75 is easily understood. Further, the stacked two plates P1 and P2 corresponds to any two of the first channel plate 48, the second channel plate 49, the third channel plate 50, the fourth channel plate 51 and the fifth channel plate 52 which are depicted in FIG. 2.

Figure 8B:
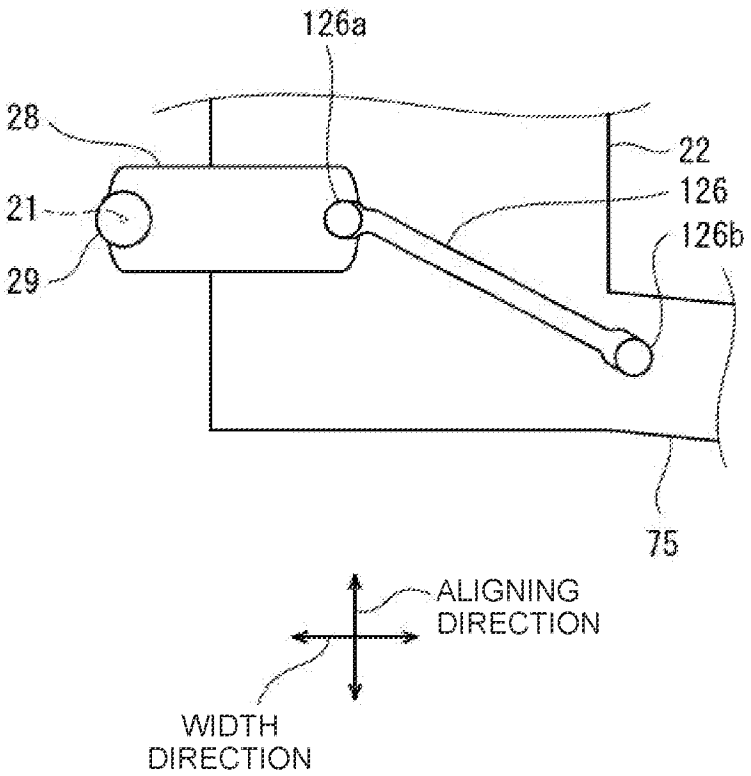
FIG. 8B is a plane view of another positional relationship between the communicating channel and the supply throttle channel.

Next, an explanation will be given about the positional relationship between the communicating channel 75 and the supply throttle channel 26 in the present embodiment, with reference to FIGS. 8A and 8B.

Figure 8A:
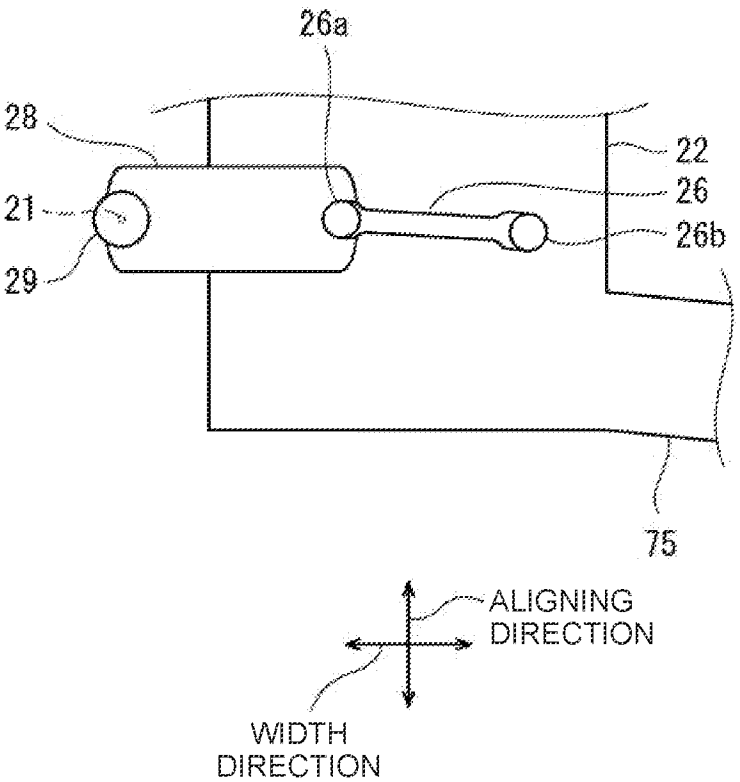
FIG. 8A is a plane view of a positional relationship between the communicating channel and a supply throttle channel.

As depicted in FIG. 8A, in the present embodiment, an upstream end 26*b*, of a certain supply throttle channel 26 which is included in a plurality of supply throttle channels 26 communicating with the supply manifold 22 and which is located at the opposite side to the side of the supply hole 24 (namely, located at the terminal end), is positioned outside of the communicating channel 75. Namely, in a plane view, the upstream end 26*b* of the certain supply throttle channel 26 and the communicating channel 75 are arranged at positions, respectively, which do not overlap with each other. Note that a reference numeral "26*a*" is a downstream end of the supply throttle channel 26. In contrast to this, it is also allowable to provide a configuration as follows. Namely, as depicted in FIG. 8B. it is allowable that an upstream end 126*b*, of a certain supply throttle channel 126 which is included in a plurality of supply throttle channels 126 communicating with the supply manifold 22 and which is located at the opposite side to the side of the supply hole 24 (namely, located at the terminal end), is arranged inside of the communicating channel 75. Namely, it is allowable that in a plane view, the upstream end 126*b* of the certain supply throttle channel 126 and the communicating channel 75 are arranged at positions, respectively, which overlap with each other.

As explained above, according to the liquid discharging head 20 of the present embodiment, it is possible to cause an appropriate amount of the liquid to flow in the communicating channel, as compared with the conventional aspect wherein the cross-sectional area of the communicating channel is constant regardless of the first number (number of the nozzle row NR associated with one of the adjacent supply manifolds 22) and the second number (number of the nozzle row NR associated with the other of the adjacent supply manifolds 22). Specifically, in a case that the cross-sectional area of the communicating channel 75 is too great, only a weak flow is generated and any air remains in the communicating channel 75. On the other hand, in a case that the channel cross-sectional area of the communicating channel 75 is too small, there is such a fear that there might be no escape for the pressure inside of the communicating channel 75 and that the concentration in the pressure might not be improved. In the present disclosure, since the cross-sectional area of the communicating channel 75 is made different depending on whether the first number and the second number are same or different, it is possible to cause an appropriate amount of the liquid to flow in the communicating channel 75 to thereby suppress any remaining of the air, and to suppress the concentration in the pressure. Specifically, in a case that the first number and the second number are different, any difference in the flow amount is likely to occur between the one and the other of the adjacent supply manifolds 22, there is a little fear that the remaining of the air might occur in the communicating channel 75. However, since the concentration in the pressure occurs in the case that the cross-sectional area of the communicating channel 75 is small, a communicating channel 75 having a relatively large cross-sectional area is provided so as to suppress the concentration in the pressure. In contrast, in the case that the first number and the second number are same, although the concentration in the pressure is relatively less likely to occur, the fear of the remaining of air is great since the difference in the flow amount is less likely to occur. Accordingly, a communicating channel 75 having a relatively small cross-sectional area is provided in view of forming a flow which is sufficient to exhaust or discharge the air in the communicating channel 75. Owing to the above-described configuration, it is possible to suppress any remaining of the air, and to suppress the concentration in the pressure.

Further, in the present embodiment, in the case that the first number and the second number are different, the channel-cross sectional area of the communicating channel 75 is great, as compared with the case that the first number and the second number are same. In the case that the first number and the second number are different, any difference in the flow amount is likely to occur between the one and the other of the adjacent supply manifolds 22, and thus there is little fear that the air might remain in the communicating channel 75. However, the concentration in the pressure occurs in the case that the cross-sectional area of the communicating channel 75 is small. Accordingly, by arranging the communicating channel 75 having a channel cross-sectional area which is greater than that in a case that the first number and the second number are same, it is possible to suppress the concentration in the pressure.

Furthermore, in the present embodiment, in the case that the first number and the second number are different, the spacing distance d1 between the communicating channel 75 and the descender 29 located closest to the communicating channel 75 is not more than the spacing distance d2 between the adjacent descenders 29. In this case, it is possible to make the width of the communicating channel 75 to be great to such an extent that the spacing distance d1 between the communicating channel 75 and the descender 29 which is located closest to the communicating channel 75 is not more than the spacing distance d2 between the adjacent descenders 29. With this, it is possible to further suppress the concentration in the pressure.

Moreover, in the present embodiment, the channel resistance in the communicating channel 75 in the case that the first number and the second number are same is in the range of 1000 kPa·s/ml to 2000 kPa·s/ml. With this, it is possible to further suppress the remaining of the air in the communicating channel 75.

Further, in the present embodiment, the channel resistance in the communicating channel 75 in the case that the first number and the second number are different is in the range of 100 kPa·s/ml to 300 kPa·s/ml. With this, it is possible to further suppress the concentration in the pressure in the communicating channel 75.

Furthermore, in the present embodiment, the communicating channel 75 is formed by performing the half etching for each of the two layer plates P1 and P2. Since a thick part can be left in each of the layers by the half etching, it is possible to obtain the structure stability.

Moreover, in the present embodiment, the upstream end 26*b* of the supply throttle channel 26 is positioned outside of the communicating channel 75. With this, is it possible to easily prevent the air inside the communicating channel 75 from entering into the supply throttle channel 26. This makes it possible to prevent any unsatisfactory discharge (ejection) due to the air.

Further, in the present embodiment, it is allowable that the upstream end 126*b* of the supply throttle channel 126 is arranged inside of the communicating channel 7. With this, it is possible to make the width of the communicating channel 75 to be great to such an extent that the upstream end 126*b* of the supply throttle channel 126 is arranged inside of into the communicating channel 75 so as to mitigate the concentration in the pressure in a case that the flow amount is increased. Further, it is possible to exhaust the air in the communicating channel 75 via the upstream end 126*b*.

Furthermore, in the present embodiment, the channel cross-sectional area of the communicating channel 75*b* connecting the supply manifold 22*b* and the supply manifold 22*c* is smaller than the channel cross-sectional area of the communicating channel 75*a* connecting the supply manifold 22*a* and the supply manifold 22*b*. Further, the channel cross-sectional area of the communicating channel 75*b* is smaller than the channel cross-sectional area of the communicating channel 75*c* connecting the supply manifold 22*c* and the supply manifold 22*d*. Regarding this point, in a case that the number of the nozzle row NR associated with the supply manifold 22*b* and the number of the nozzle row NR associated with the supply manifold 22*c* adjacent to the supply manifold 22*b* is same, it is possible to make the channel cross-sectional area of the communicating channel 75*b* to be smaller than that in the case that the first number and the second number are different, from the viewpoint of forming a flow sufficient for exhausting the air.

(Modification)

The present disclosure is not limited to or restricted by the above-described embodiment; a variety of kinds of modification is possible within a range not departing from the gist of the present disclosure. The modification is, for example, exemplified as follows.

Figure 9:
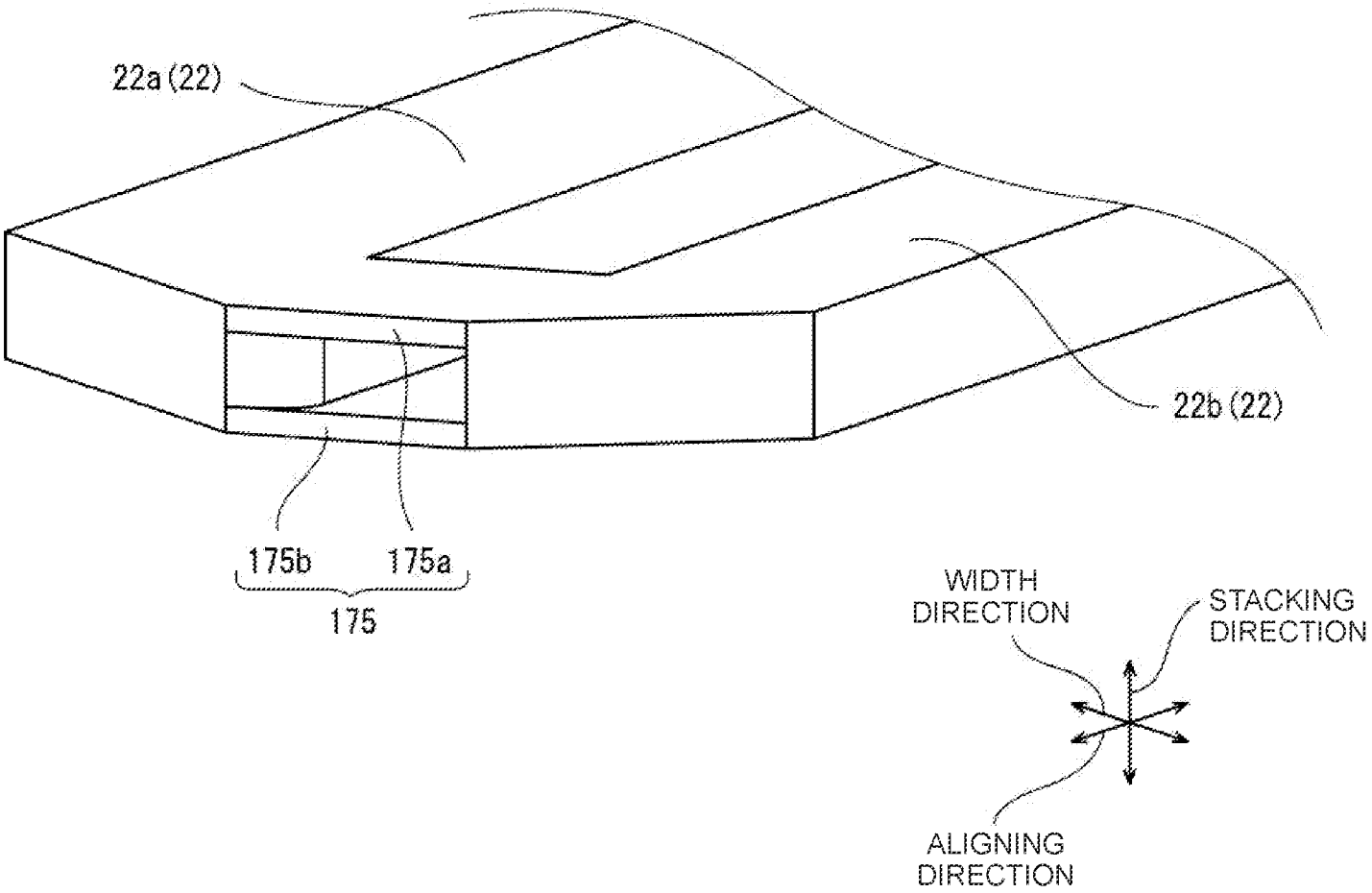
FIG. 9 is a perspective view of another communicating channel.

In the above-described embodiment, the adjacent supply manifolds 22 are connected to each other by one piece of the communicating channel 75. The present disclosure, however, is not limited to this. FIG. 9 is a perspective view of a communicating channel 175 which is a modification of the above-described communicating channel 75. Note that in the following description, although an explanation will be given representatively regarding the communicating channel 175 connecting the supply manifold 22*a* and the supply manifold 22*b*, the explanation is similarly applicable also to a communicating channel connecting the supply manifold 22*b* and the supply manifold 22*c* and to a communicating channel connecting the supply manifold 22*c* and the supply manifold 22*d*.

As depicted in FIG. 9, the communicating channel 175 according to the modification includes a first communicating channel 175*a* and a second communicating channel 175*b*. The first communicating channel 175*a* connects an upper end of one supply manifold 22*a* and an upper end of the other supply manifold 22*b*. Further, the second communicating channel 175*b* connects a lower end of the one supply manifold 22*a* and a lower end of the other supply manifold 22*b*. With such a configuration, it is possible to exhaust the air by the first communicating channel 175*a*, and to secure the damper function by the second communicating channel 175*b*.

Figure 10:
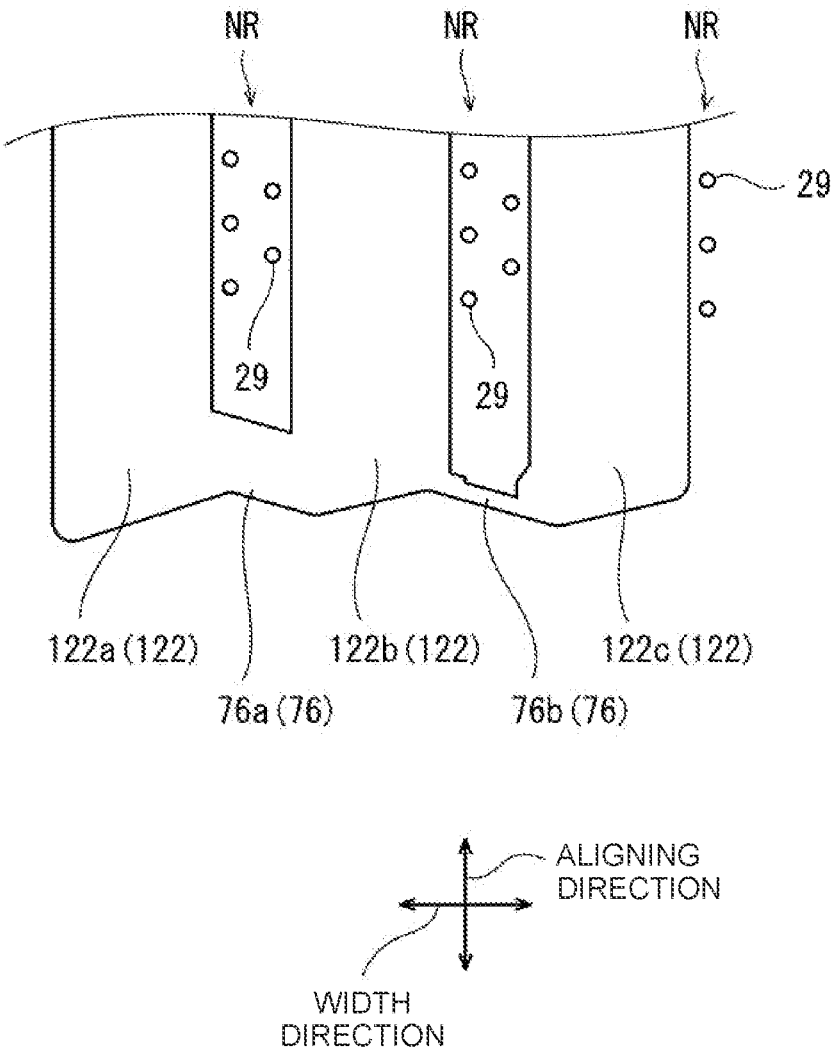
FIG. 10 is a plane view of another supply manifold.

Furthermore, in FIG. 6 of the above-described embodiment, the aspect in which the four supply manifolds 22 (22*a*, 22*b*, 22*c* and 22*d*) are provided are explained. The present disclosure, however, is not limited to this. As depicted in FIG. 10, it is also allowable to adopt an aspect in which three supply manifolds 122 (122*a*, 122*b*, 122*c*) are provided. Adjacent supply manifolds 122 which are included in the three manifolds 122 and which are adjacent to each other are connected by a communicating channel 76. One nozzle row NR is connected to an inner side in the width direction of the supply manifold 122*a*. On the other hand, two nozzle rows NR are connected, respectively, to the both side in the width direction of each of the supply manifolds 122*b* and 122*c*. Accordingly, in the relationship between the supply manifold 122*a* and the supply manifold 122*b* which are adjacent to each other, the first number and the second number are different. In contrast, in the relationship between the supply manifold 122*b* and the supply manifold 122*c* which are adjacent to each other, the first number and the second number are same. In this case, the channel cross-sectional area of the communicating channel 76*a* connecting the supply manifold 122*a* and the supply manifold 122*b* is greater than the channel cross-sectional area of the communicating channel 76*b* connecting the supply manifold 122*b* and the supply manifold 122*c*. In this case, each of channel cross-sectional areas in respective parts of the communicating channel 76*a*, namely each of cross sectional areas of respective planes, of the communicating channel 76*a*, which are orthogonal to a flow direction, is greater than the maximum value of cross sectional areas of respective planes, of the communicating channel 76*b*, which are orthogonal to the flow direction.

Moreover, in the above-described embodiment, the supply hole 24 is formed to have the square shape. The present disclosure, however, is not limited to this; it is allowable to form the supply hole 24 to have, for example, a circular shape.

What is claimed is:

1. A liquid discharging head comprising:

a plurality of manifolds to which liquid is supplied;

at least one nozzle row associated with each of the manifolds; and a communicating channel directly connected to two manifolds which are included in the manifolds and which are adjacent to each other, wherein the at least one nozzle row includes a plurality of nozzles opening in a nozzle surface and configured to discharge the liquid, the nozzles communicating with one manifold with which the at least one nozzle row is associated, a first number is a number of the nozzle row associated with one of the two manifolds and a second number is a number of the nozzle row associated with the other of the two manifolds, a cross-sectional area of the communicating channel is different between a case that a first number and a second number are same, and another case that the first number and the second number are different, and the communicating channel does not overlap with the nozzles as viewed in a direction orthogonal to the nozzle surface.

2. The liquid discharging head according to claim 1, wherein in the another case that the first number and the second number are different, the cross-sectional area of the communicating channel is greater than in the case that the first number and the second number are same.

3. The liquid discharging head according to claim 1, further comprising a plurality of descenders each of which is connected to one of the nozzles, wherein, in the another case that the first number and the second number are different, a spacing distance between the communicating channel and a descender which is located closest to the communicating channel is not more than a spacing distance between two descenders which are adjacent to each other.

4. The liquid discharging head according to claim 1, wherein in the case that the first number and the second number are the same, a channel resistance in the communicating channel is in a range of 1000 kPa·s/ml to 2000 kPa·s/ml.

5. The liquid discharging head according to claim 1, wherein in the another case that the first number and the second number are different, a channel resistance in the communicating channel is in a range of 100 kPa·s/ml to 300 kPa·s/ml.

6. The liquid discharging head according to claim 1, wherein the communicating channel includes a first communicating channel configured to connect an upper end of the one of the two manifolds and an upper end of the other of the two manifolds, and a second communicating channel configured to connect a lower end of the one of the two manifolds and a lower end of the other of the two manifolds.

7. The liquid discharging head according to claim 1, wherein the communicating channel is formed by half etching performed for each of two layer plates.

8. The liquid discharging head according to claim 1, further comprising a plurality of supply throttle channels communicating with each of the manifolds, wherein a plurality of upstream ends of the supply throttle channels are positioned outside of the communicating channel connected to the two manifolds.

9. The liquid discharging head according to claim 1, further comprising a plurality of supply throttle channels communicating with each of the manifolds, wherein a plurality of upstream ends of the supply throttle channels include an upstream end which is positioned inside of the communicating channel connected to the two manifolds.

10. The liquid discharging head according to claim 1, wherein the manifolds include first to fourth manifolds arranged side by side in a width direction orthogonal to a direction which is along the at least one nozzle row, one nozzle row is associated with each of the first manifold and the fourth manifold, two nozzle rows are associated with each of the second manifold and the third manifold, and a cross-sectional area of the communicating channel connecting the second manifold and the third manifold is smaller than a cross-sectional area of the communicating channel connecting the first manifold and the second manifold and smaller than a cross-sectional area of the communicating channel connecting the third manifold and the fourth manifold.

* * * * *